US006335496B1

(12) United States Patent
Miyashita

(10) Patent No.: US 6,335,496 B1
(45) Date of Patent: Jan. 1, 2002

(54) MULTI-DIRECTIONAL SWITCH HAVING A PLURALITY OF MANUAL SWITCHES

(75) Inventor: Isao Miyashita, Fujiyoshida (JP)

(73) Assignee: Citizen Electronics Co., Ltd., Yamanashi-ken (JP)

( * ) Notice: Subject to any disclaimer, the term of this patent is extended or adjusted under 35 U.S.C. 154(b) by 0 days.

(21) Appl. No.: 09/598,849

(22) Filed: Jun. 21, 2000

(30) Foreign Application Priority Data

Jun. 21, 1999 (JP) ..... 11-174370

(51) Int. Cl.[7] ..... H01H 25/04
(52) U.S. Cl. ..... 200/5 R; 200/5 A
(58) Field of Search ..... 200/4, 5 R, 6 R, 200/6 A, 17 R, 18, 339

(56) References Cited

U.S. PATENT DOCUMENTS 4,256,931 A * 3/1981 Palisek ..... 200/5 A
5,498,843 A * 3/1996 Date et al. ..... 200/6 A
5,621,196 A * 4/1997 Nishijima et al. ..... 200/6 A
5,631,453 A * 5/1997 Maeda ..... 200/6 A
5,889,242 A * 3/1999 Ishihara et al. ..... 200/6 A
5,952,628 A * 9/1999 Sato et al. ..... 200/4

* cited by examiner

*Primary Examiner*—Michael Friedhoffer
(74) *Attorney, Agent, or Firm*—Birch, Stewart, Kolasch & Birch, LLP

(57) ABSTRACT

A plurality of fixed contacts and a movable contact are provided on a substrate so that opposite contacts form a unit switch. A holding plate having a holding corner is mounted on the substrate, and an operating plunger having a plurality of radially extending arms is slidably mounted in a hole formed in the holding plate, and rotatably held in the holding corner so as to be tilted about the holding corner. A plurality of projections are formed on the underside of the plunger, each of the projections is provided corresponding to the movable contact.

3 Claims, 5 Drawing Sheets

MULTI-DIRECTIONAL SWITCH HAVING A PLURALITY OF MANUAL SWITCHES

BACKGROUND OF THE INVENTION

The present invention relates to a multi-directional switch comprising a plurality of manual switches and used in electronic devices such as a portable telephone, video camera, car radio and others.

The multi-directional switch comprises a plurality of fixed contacts circularly arranged in a housing, and an operating plunger tiltably provided in the housing and having a plurality of branches, each having a movable contact which can be contacted with a corresponding fixed contact in the housing by manipulating the operating plunger, thereby producing a specific signal.

FIG. 10 is a plan view of a multi-directional switch disclosed in the Japanese Utility Model Application Laid Open 1-111431, FIG. 11 is a sectional side view of the switch.

A multi-directional switch has four push button switches 12 on a substrate 11, disposed on a cross line. An operating plunger 13 has an operating lever 13*a*, a spherical portion 13*c*, a conical recess 13*d*, four restricting portions 13*b* on the cross line, each restricting portion 13*b* has a parallelepiped shape. The operating plunger 13 is rotatably held by a spherical portion 15*a* of a cover of a case 14 and a conical support 16 secured to the substrate 11.

The plunger 13 has four receiving arms 13*e* and four operating arms 13*f* in the cross line direction. A spring 17 secured to the case 14 engages with each receiving arm 13*a*, thereby holding the operating lever 13*a* of the plunger 13 in the vertical position.

In accordance with the above described construction, the inclination direction of the plunger 13 is restricted by restricting portions 13*b* to four directions on the cross line. Four perforations 18 are formed in the spherical portion 15*a*, each corresponding to the restricting portion 13*b*. Thus, the plunger 13 can be tilted, inserting the restricting portion 13*b* in the perforation 18. If the plunger 13 is pushed in other directions than the cross line direction, the plunger 13 can not be tilted since the restricting portion 13*b* engages with a stopping portion 15*b* of the cover 15.

When the plunger 13 is tilted in one of the four directions the operating arm 13*f* pushes a push button 12*a* of one of the switches 12.

In the conventional switch 10, since the conical support 16 is provided in the central position of the switch, it is impossible to modify the switch to a versatile switch in which an additional push button switch is provided at the central position. Further, in such a versatile switch, the plunger must be provided so as to be vertically moved to operate the central switch. However, in the conventional switch, the height of the switch becomes large.

In addition, since the spherical portion 13*c* is provided in the central portion, a vertical guide portion for vertically guiding the operating lever 13*a* is provided on the spherical portion 15*a*, the height of the switch becomes large, and the construction thereof becomes complicated.

SUMMARY OF THE INVENTION

An object of the present invention is to provide a multi-directional switch having a central switch.

Another object is to provide a multi-directional switch which may be reduced in size and height and simple in construction.

According to the present invention, there is provided a multi-directional manual switch comprising, a substrate having a central fixed contact and a plurality of peripheral fixed contacts and a central movable contact and a plurality of peripheral movable contacts, each of the movable contacts being provided above each of the fixed contacts so that opposite contacts form a unit switch, a holding plate having a first holding corner formed on an underside thereof and mounted on the substrate, an operating plunger having a plurality of radially extending arms, and slidably, mounted in hole formed in the holding plate, and rotatably held in the first holding corner so as to be tilted about the first holding corner, and a plurality of projections formed on the underside of the plunger comprising a central projection and a plurality of peripheral first projections, each of the projections being provided corresponding to the movable contact.

The operating plunger is axially slidably held in the holding corner.

A plurality of second holding corner are formed on the underside of the holding plate, a peripheral plunger is provided between the peripheral projection and second holding corner so as to be pivoted about the corner, a second projection is formed on the underside of the peripheral plunger, each of the peripheral fixed contacts is offset from the peripheral projection and disposed so that the peripheral movable contact is depressed by the second projection.

The stroke between a top of the central projection and a surface of the central fixed contact is smaller than a stroke between a top of the second projection and a surface of the peripheral fixed contact.

The length between the peripheral first projection and the second projection is longer than a length between the second projection and the second holding corner.

These and other objects and features of the present invention will become more apparent from the following detailed description with reference to the accompanying drawings.

DETAILED DESCRIPTION OF THE PREFERRED EMBODIMENT

Figure 1:
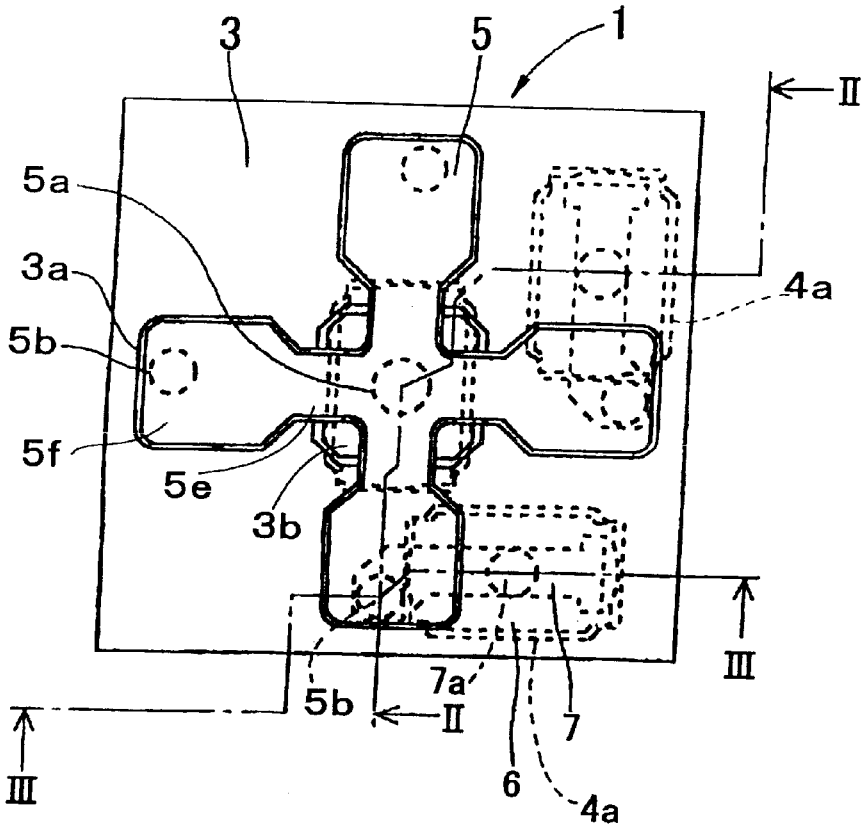
FIG. 1 is a plan view showing a multi-directional switch according to the present invention.
Figure 3:
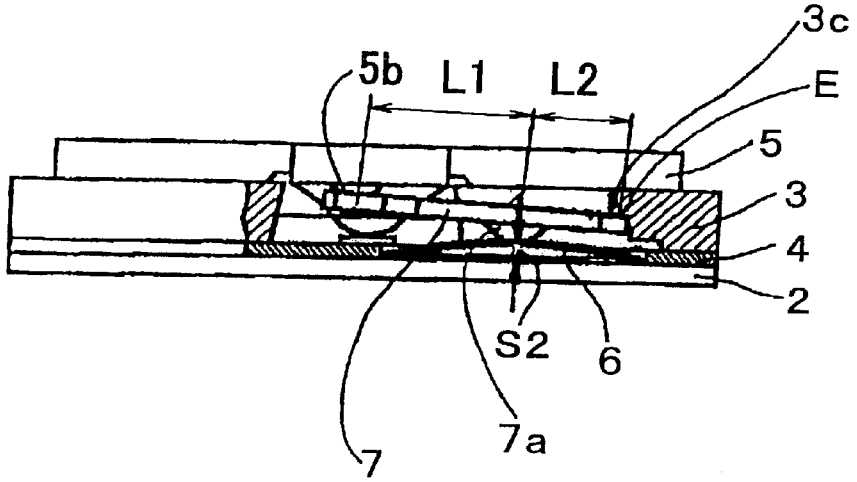
FIG. 3 is a sectional view taken along a line III—III of FIG. 1.
Figure 2:
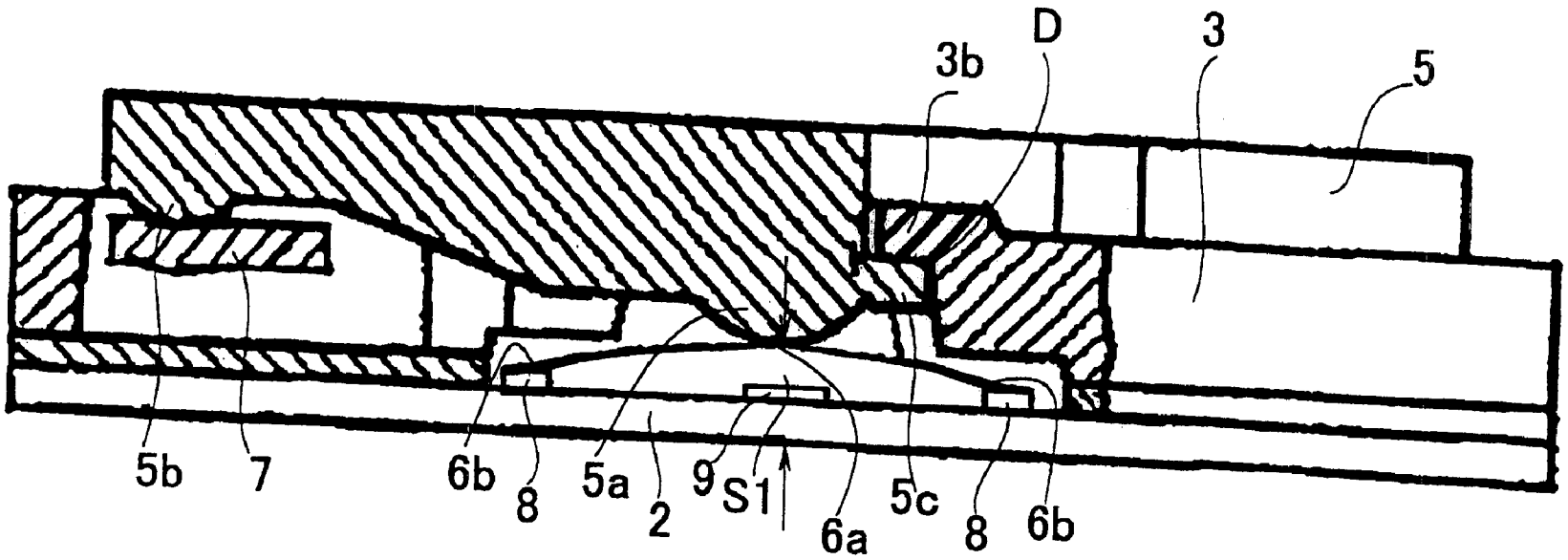
FIG. 2 is a sectional view taken along a line II—II of FIG. 1.
Figure 4:
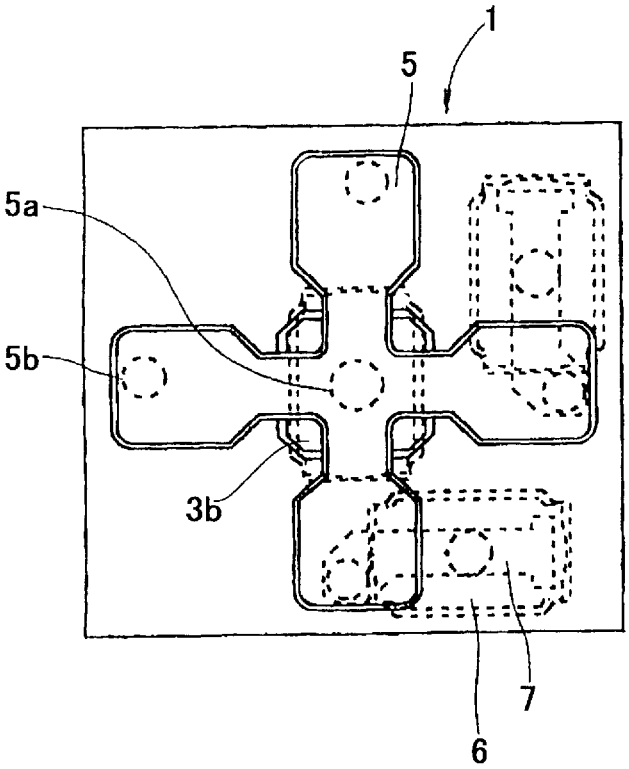
FIGS. 4 to 6 are similar drawings to FIGS. 1 to 3 for explaining one of operations of the switch.

Referring to FIGS. 1 through 3, the multi-directional switch of the present invention comprises a flat body 1 and a flat operating plunger 5.

The body 1 is formed by laminating a plastic holding plate 3, a plastic spacer 4 and a substrate 2. As shown in FIG. 1, the body 1 has a square shape. The holding plate 3 has a hole 3*a* in a shape of a cross. Each branch hole of the hole has a narrow base portion and a wide end portion.

The operating plunger 5 has four arms having a similar shape to the hole 3*a* and is slidably mounted in hole 3*a*. Each arm of the operating plunger 5 comprises a narrow base portion 5*e* and a manipulating end portion 5*f*. The gap between the manipulating end portion 5*f* and the wall of the hole 3*a* is small so that the arm may not pivot in the hole.

Referring to FIGS. 1 and 2, the holding plate 3 has four holding corner 3*b* between adjacent branch holes 3*a*. The operating plunger 5 has four projections 5*c* between adjacent base portions. The projections 5*c* are rotatably held by the holding corner and prevented from upwardly removing, thereby providing a first fulcrum D.

Referring to FIG. 1, five rectangular apertures 4*a* (two apertures are not depicted) are formed in the spacer 4 at a central portion and at four portions corresponding to manipulating end portions 5*f* of the operating plunger 5.

The rectangular aperture 4*a* at the end portion 5*f* is disposed at the right angle to the arm of the plunger 5. In each aperture 4*a*, a rectangular movable contact 6 is disposed and positioned therein. As shown in FIG. 2, the movable contact 6 has an arcuated shape in section having a central top portion 6*a* and opposite ends 6*b*. Each end 6*b* contacts with a fixed contact 8 provided on the substrate 2. The top portion 6*a* is positioned above a central fixed contact 9 on the substrate 2.

Referring to FIGS. 1 and 2, on the underside of a central portion of the operating plunger 5, a spherical central projection 5*a* is formed corresponding to the central fixed contact 9, and a spherical peripheral projection 5*b* is formed on the underside of each manipulating end portion 5*f*.

A peripheral metal plunger 7 having a spherical projection 7*a* is disposed on the movable contact 6 at the end portion 5*f*. An inner side end of the peripheral plunger 7 contacts with the spherical projection 5*b* of the end portion 5*f* and the outer side end engages with a holding corner 3*c* of the holding plate 3, and the spherical projection 7*a* contacts with the top portion 6*a* of the movable contact 6.

Thus, the holding corner 3*c* provides a second falcrum E.

The stroke S1 (FIG. 2) between the top of the spherical projection 5*a* and the surface of the fixed contact 9 is set to a value smaller than the stroke S2 (FIG. 3) between the projection 7*a* and the fixed contact 9 (S1<S2). As shown in FIG. 3, the length L1 from the contact point of the projection 5*b* with the plunger 7 to the contact point of the projection 7*a* with the movable contact 6 is set a value larger than the length L2 from the contact point 7*a* to the second falcrum E (L1>L2).

Figure 5:
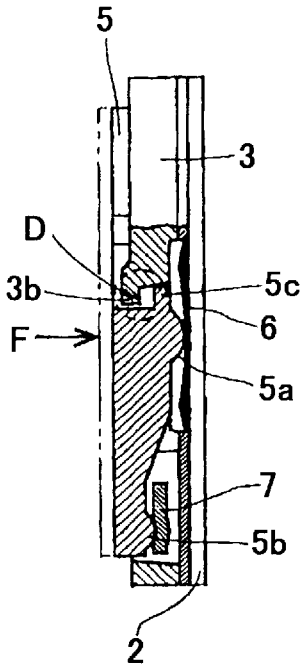
Figure 6:
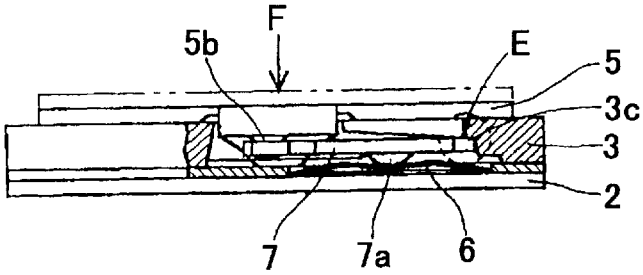
Figure 7:
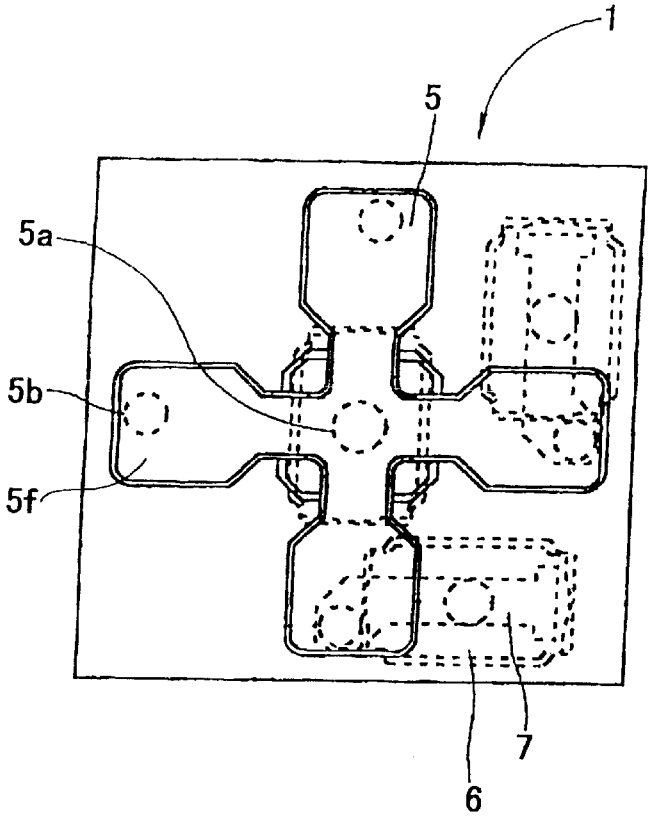
FIGS. 7 to 9 are similar drawings to FIGS. 1 to 3 for explaining another operation of the switch.

In operation, referring to FIGS. 5 and 6, when a central portion of the operating plunger 5 is depressed by a finger of an operator as shown by an arrow F, the operating plunger is lowered, keeping a horizontal position. Consequently the central movable contact 6 is yielded to be contacted with the central fixed contact 9 on the substrate 2. Thus the fixed contacts 8 are connected to the central fixed contact 9 by the movable contact 6, so that the central switch is closed. At that time, since the stroke S2 is larger than the stroke S1, the projections 7*a* do not largely deform the peripheral movable contacts 6 as shown in FIG. 6. Therefore, the peripheral switches are not closed.

Figure 8:
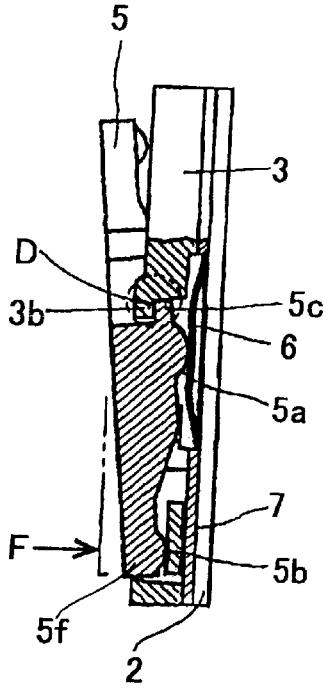
Figure 9:
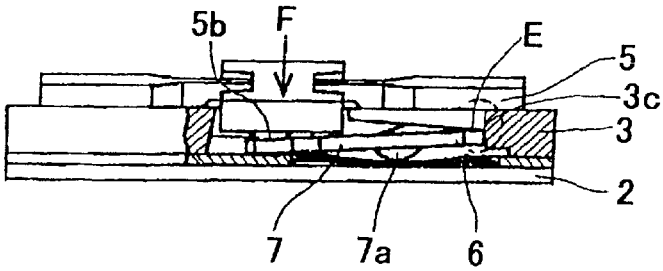
Figure 10:
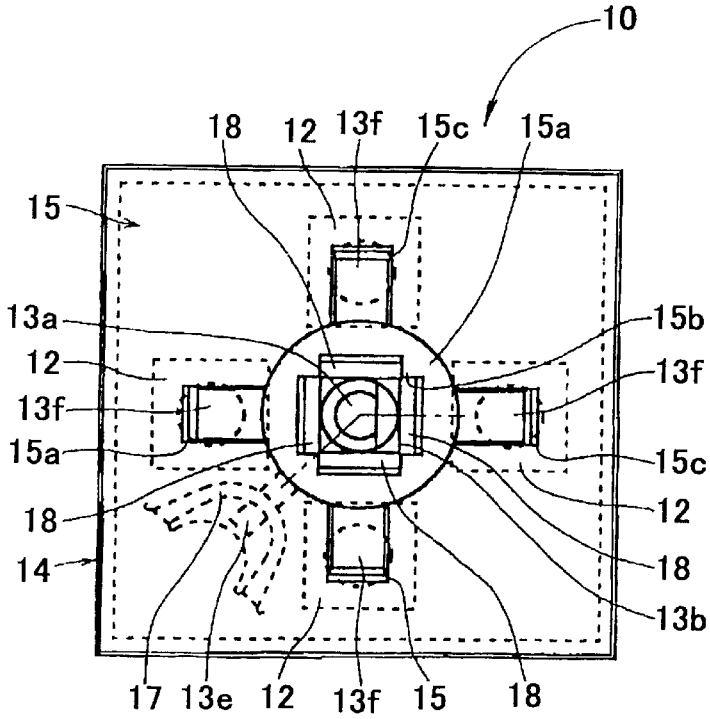
FIG. 10 PRIOR ART
FIG. 10 is a plan view of a conventional multi-directional switch.
Figure 11:
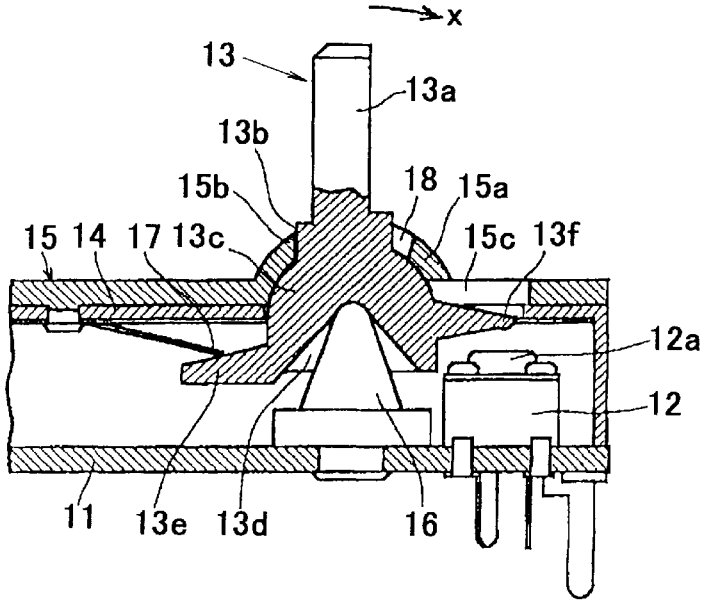
FIG. 11 PRIOR ART
FIG. 11 is a sectional side view of the switch.

Referring to FIGS. 8 and 9, when one of the manipulating end portions 5*f* of the operating plunger 5 is depressed, the plunger 5 is tilted about the first fulcrum D as shown in FIG. 8. Thus, the spherical peripheral projection 5*b* deforms the peripheral movable contact 6, so that the movable contact 6 is contacted with the fixed contact 9. Thus, the peripheral switch is closed.

At that time, the central projection 5*a* does not largely move as shown in FIG. 8. Therefore, the projection 5*a* does not largely deform the central movable contact 6. Thus, the central switch is not closed. Since L1 is larger than L2, the projection 7*a* deforms the movable contact 6 at a small force.

In accordance with the present invention, a multi-directional switch having a central switch can be provided. Since the multi-directional switch is composed by a flat body and a flat operating plunger, the thickness of the switch can be reduced and the construction is simple. In addition, since the plunger is mounted in a hole of the body, the thickness is further reduced.

While the invention has been described in conjunction with preferred specific embodiment thereof, it will be understood that this description is intended to illustrate and not limit the scope of the invention, which is defined by the following claims.

What is claimed is:

1. A multi-directional manual switch comprising:

a substrate having a central fixed contact and a plurality of peripheral fixed contacts and a central movable contact and a plurality of peripheral movable contacts, each of the movable contacts being provided above each of the fixed contacts so that opposite contacts form a unit switch;

a holding plate having a first holding corner formed on an underside thereof and mounted on the substrate;

an operating plunger having a plurality of radially extending arms, and slidably mounted in a hole formed in the holding plate, and rotatably held in the first holding corner so as to be tilted about the first holding corner;

a plurality of first projections formed on the underside of the plunger, comprising a central projection and a plurality of peripheral first projections, each of the projections being provided corresponding to each of the movable contacts, wherein the operating plunger is axially slidably held in the holding corner, the central movable contact has an arcuated shape in section, having a central top portion and opposite ends, and a plurality of second holding corners formed on an underside of the holding plate, a peripheral plunger is provided between each of the peripheral projections and each of the second holding corners so as to be pivoted about the second holding corners; and a second projection is formed on an underside of the peripheral plunger, each of the peripheral fixed contacts is offset from each peripheral projection and disposed so that the peripheral movable contacts is depressed by the second projection.

2. The multi-directional manual switch according to claim 1 wherein a stroke between a top of the central projection and a surface of the central fixed contact is smaller than a stroke between a top of the second projection and a surface of each of the peripheral fixed contacts.

3. The multi-directional manual switch according to claim 1 wherein a length between the peripheral first projection and the second projection is larger than a length between the second projector and the second holding corner.

* * * * *